US005241140A

United States Patent [19]

Itoh et al.

[11] Patent Number: 5,241,140

[45] Date of Patent: Aug. 31, 1993

[54] SPEAKER DIAPHRAGM

[75] Inventors: Hiroaki Itoh; Kenzaburou Iijima; Toshiharu Hoshi, all of Shizuoka, Japan

[73] Assignee: Yamaha Corporation, Japan

[21] Appl. No.: 606,310

[22] Filed: Oct. 31, 1990

[30] Foreign Application Priority Data

Nov. 1, 1989 [JP] Japan ..... 1-285783

[51] Int. Cl.[5] ..... G10K 13/00

[52] U.S. Cl. ..... 181/169; 181/170

[58] Field of Search ..... 181/169, 170; 428/408, 428/260, 245, 265, 252, 272

[56] References Cited

U.S. PATENT DOCUMENTS 4,772,513 9/1988 Sakamoto et al. ..... 181/170 X 4,935,303 6/1990 Ikoma et al. ..... 428/408

5,031,720 7/1991 Ohta et al. ..... 181/169

*Primary Examiner*—Michael L. Gellner

*Assistant Examiner*—Khanh Dang

*Attorney, Agent, or Firm*—Ostrolenk, Faber, Gerb & Soffen

[57] ABSTRACT

A speaker diaphragm has a laminated construction in which a core layer is made of a porous diamond type wafer or wafers and sandwiched by a pair of surface layers made of diamond type material. Presence of numerous small pores in the core layer reduces the specific gravity of the entire diaphragm, thereby increasing efficiency in acoustic conversion. The porous construction of the core layer reduces internal loss of the diaphragm, and suppresses resonance in the treble range.

3 Claims, 1 Drawing Sheet

SPEAKER DIAPHRAGM

BACKGROUND OF THE INVENTION

The present invention relates to a speaker diaphragm and more particularly relates to improvement in acoustic characteristics of a diamond type diaphragm used for speakers.

Typical diamond type speaker diaphragms are disclosed in Japanese Patent Publication Sho. 55-33237 and Japanese Patent Laid-Open Sho. 59-143498.

The diamond type speaker diaphragm of the Publication Sho. 55-33237 is produced by ion beam vacuum evaporation of carbon ion and made up of a carbon material close in crystal construction and physical properties to diamond. The diamond type speaker diaphragm of the Laid-Open Sho. 59-143498 is produced by a CVD (chemical Vapour Deposition) process and made up of a diamond type carbon material.

These diamond type speaker diaphragms on one hand exhibit excellent acoustic characteristics in the middle and treble frequency ranges, i.e. in the region up to several times ten kHz thanks to their large Young's moduli. On the other hand, however, they are very low in efficiency in acoustic conversion (electrocoustic transduction) due to their large specific gravities and accompanied with resonance in the treble range due to their small internal loss. As a result, these conventional speaker diaphragms generate tones with unpleasant tone colours resulting in harsh sounding audio.

SUMMARY OF THE INVENTION

It is the object of the present invention to raise efficiency in acoustic conversion and suppress resonance in the treble frequency range to obtain flat frequency characteristics in performance of a diamond type speaker diaphragm.

To this end, the diamond type speaker diaphragm in accordance with the present invention has a laminated construction including a core layer made of a diamond type porous material.

DESCRIPTION OF THE PREFERRED EMBODIMENTS

The term "diamond type material" used herein refers to a carbonic material equal or very close in crystal structure and/or physical properties such as Young's modulus, density, dielectric constant, refractive index and specific resistance to those of a diamond. Such a diamond type material is generally produced by CVD process using methane gas as the starting material, ion beam vacuum evaporation, electron beam vacuum evaporation and spattering process.

Figure 1:
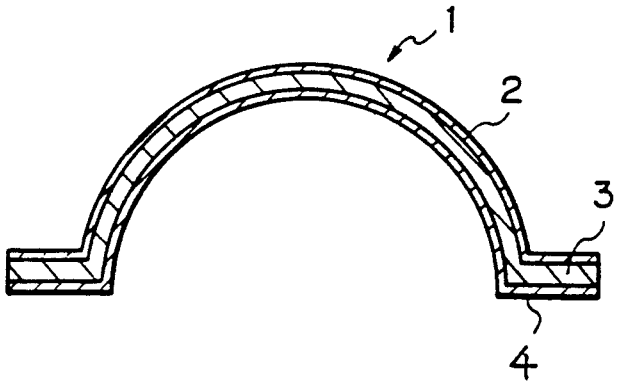
FIG. 1 is a sectional side view of one embodiment of the speaker diaphragm in accordance with the present invention.

In FIG. 1, a speaker diaphragm 1 in accordance with the present invention is made up of a core layer 3 and a pair of surface layers 2 and 4 sandwiching the core layer 3.

The surface layers 2 and 4 are each given in the form of a diamond type substance which is solid in structure including substantially no space and/or void. In an alternative, at least one of the surface layer may be made up of two or more diamond type thin films different in crystal structure and/or physical properties. The thickness of the surface layer is preferably in a range from 1 to 20 μm.

The core layer 3 is made of a porous wafer of a diamond type material which includes lots of spaces and/or voids in the form of random pores, honeycomb pores or juxtaposed pores. The degree of porosity of the core layer 3 is preferably in a range from 5 to 95% by volume. When the degree of porosity falls short of 5%, no appreciable reduction in specific gravity of the entire diaphragm 1 is obtained significant and no increase in internal loss could be expected. Any degree of porosity beyond 95% results in poor mechanical strength of the diaphragm 1.

Just like the surface layers 2 and 4, the core layer 3 may be made up of two or more diamond type wafers different in at least one of the degree of porosity, the crystal structure and the shape of pores. The thickness of the core layer 3 is preferably in a range from 5 to 50 μm. The diamond type speaker diaphragm having the above thickness layers is preferable in combination with a magnetic circuit which is usually used for the Ti or Al diaphragm speaker in diameter from ⅜ to 4 inches.

In production of the core layer 3, a solid wafer made of diamond type material may be first prepared and dry etching is applied to this solid wafer using water, hydrogen or oxygen in plasma. By adjusting process conditions in preparation of the solid wafer and/or in the dry etching, wafers of various degrees of porosity can be obtained.

In one example, the diaphragm 1 may be arranged on a flat substrate made of, for example Al, Ti or Be. In production of such a substrate mounted type diaphragm, a substrate made of silicon etc. and same in profile with the diaphragm 1 is prepared and a solid diamond type wafer is formed on this substrate via CVD process, plasma CVD process or ion vacuum evaporation. Next, plasma etching is applied to the solid wafer in its thickness direction for formation of pores. Additional diamond type wafers are formed on the porous wafer in the same manner. Finally, when required, the substrate may be removed via solution. In an alternative, the substrate may be made of Al or Ni which are suited for shaping. After formation of a silicon wafer on the substrate via, for example vacuum evaporation, the above described three layer laminated construction may be formed thereon.

EXAMPLES

A silicon substrate was placed in position within a micro wave plasma CVD equipment generative of micro waves of 2.45 GHz and diamond type wafers were formed on the silicon substrate under the following conditions. The temperature of the substrate was maintained at 800° C. and the interior of the equipment was maintained under a vacuum condition of 30 Torr. Methane and hydrogen gases were used for wafer formation;

(i) Concentration of the methane gas was set to 0.5% by volume and wafer formation was continued for 20 Hrs under this condition.

(ii) Concentration of the methane gas was next set up to 3.5% by volume and wafer formation was continued for 60 Hrs under this condition.

(iii) Density of the methane gas was set to 1.5% by volume and wafer formation was continued for 10 Hrs under this condition.

(iv) After complete evacuation of the methane gas from interior of the equipment, oxygen gas was introduced and plasma etching was carried out under a vacuum condition of 30 Torr.

(v) The interior of the equipment was again evacuated completely and hydrogen and methane gas was introduced. Wafer formation was carried out for 20 Hrs. at a methane gas concentration of 0.5% by volume.

Figure 2:
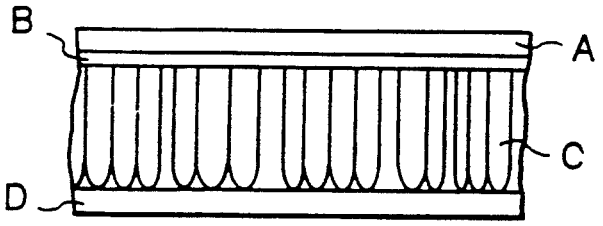
FIG. 2 is a sectional view of a diaphragm obtained in one example of the present invention.

The state of the cross section of a sample obtained is shown in FIG. 2. In the illustrated construction, layers A and D are each made of randomly developed multi-crystal diamond and 3 μm in thickness. A layer B is made of randomly developed multi-crystal diamond which was subjected to plasma etching and 2 μm in thickness. The porosity of this layer was 30% by volume. A layer C is made of (1 1 0) type anisotropic diamond and 17 μm in thickness. The porosity of this layer was 50% by volume.

In the above-described wafer formation, the third step was employed to develop plasma etching into a (1 1 0) type anisotropic wafer and, concurrently, to promote uniform development of randomly developed multi-crystal diamond.

Figure 3:
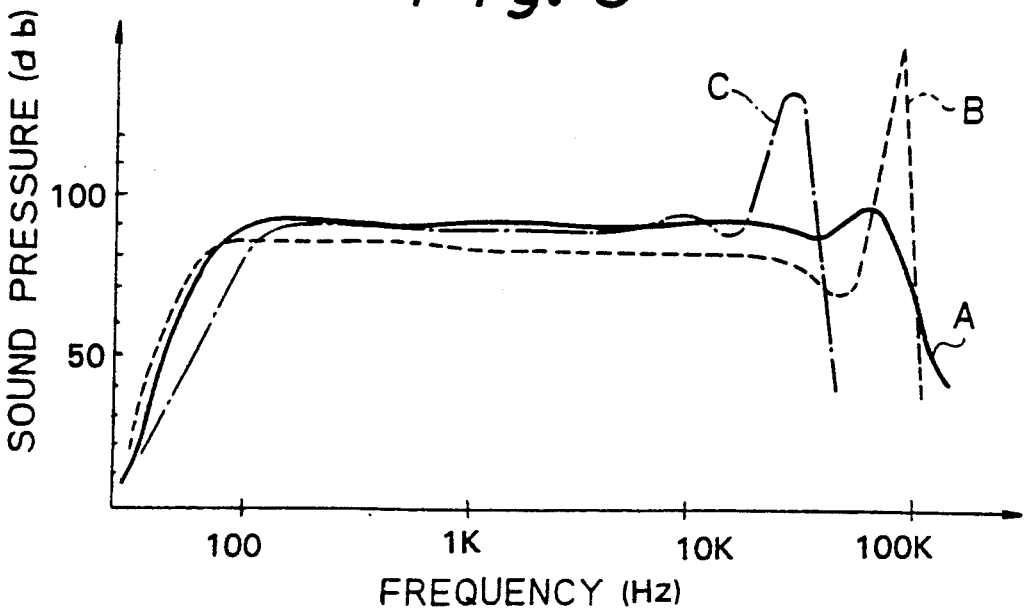
FIG. 3 is a graph for showing the frequency characteristics of diaphragms obtained in examples of the present invention.

Using this sample, a diaphragm of 25.5 mm in diameter, 17.5 mm in radius of curvature and 25 μm in thickness was prepared and subjected to measurement of its frequency characteristics. The result is shown with a solid line curve A in FIG. 3. A dot line B is for a diaphragm of 25 μm thickness made of a conventional diamond wafer and a chain line C is for a diaphragm of 30 μm thickness made of a conventional Be wafer.

As is clear from this experimental results, use of the speaker diaphragm in accordance with the present invention assures beautiful sound reproduction even in the treble frequency range when compared with that made of Be wafer. In addition, when compared with the conventional diaphragm made of usual diamond wafer only, resonance in the treble frequency range is apparently suppressed and flat frequency characteristics are obtained in the case of the speaker diaphragm in accordance with the present invention.

We claim:

1. A laminated speaker diaphragm comprising a pair of surface layers each constructed of a diamond type material and a porous core layer sandwiched between said pair of surface layers and constructed of a diamond type material, said core layer possessing a degree of porosity that is in a range of from 5 to 95% by volume.

2. A laminated speaker diaphragm comprising a pair of surface layers each constructed of a diamond type material and a porous core layer sandwiched between said pair of surface layers and constructed of a diamond type material, said core layer having a thickness in the range of 5 to 50 μm, each of said surface layers being of a thickness in the range of 1 to 20 μm.

3. A laminated speaker diaphragm comprising a pair of surface layers each constructed of a diamond type material and a porous core layer sandwiched between said pair of surface layers and constructed of a diamond type material, each of said surface layers having a thickness in the range of 1 to 20 μm.

* * * * *